US008297945B2

(12) United States Patent
Spaggiari

(10) Patent No.: US 8,297,945 B2
(45) Date of Patent: Oct. 30, 2012

(54) AXIAL FAN

(75) Inventor: Alessandro Spaggiari, Correggio (IT)

(73) Assignee: SPAL Automotive S.R.L. (IT)

( * ) Notice: Subject to any disclaimer, the term of this patent is extended or adjusted under 35 U.S.C. 154(b) by 592 days.

(21) Appl. No.: 12/311,164

(22) PCT Filed: Jun. 28, 2007

(86) PCT No.: PCT/IB2007/001781

§ 371 (c)(1),
(2), (4) Date: Mar. 20, 2009

(87) PCT Pub. No.: WO2008/047187

PCT Pub. Date: Apr. 24, 2008

(65) Prior Publication Data

US 2010/0068081 A1 Mar. 18, 2010

(30) Foreign Application Priority Data

Sep. 21, 2006 (IT) ..... BO2006A0652

(51) Int. Cl.
*F04B 35/00* (2006.01)

(52) U.S. Cl. ..... 417/352

(58) Field of Classification Search ..... 417/415, 417/416, 423.1, 352
See application file for complete search history.

(56) References Cited

U.S. PATENT DOCUMENTS 5,586,871 A 12/1996 Barnes et al.
6,158,985 A * 12/2000 Watanabe et al. ..... 417/423.14
2002/0153787 A1 10/2002 Hollenbeck et al.

FOREIGN PATENT DOCUMENTS

EP 1 094 223 A2 4/2001
GB 2 048 381 A 12/1980

OTHER PUBLICATIONS

Machine translation of JP 2000-018194.*

* cited by examiner

*Primary Examiner* — Anh Mai
*Assistant Examiner* — Zachary J Snyder
(74) *Attorney, Agent, or Firm* — Timothy J. Klima; Shuttleworth & Ingersoll, PLC

(57) ABSTRACT

In an axial fan (1), equipped with a frame (13), a motor (2) and an impeller (3) whose hub (15) is rotationally driven by the motor (2) and where the hub (15) is cup-shaped, with an end wall (16) and an annular side wall (17) to partially contain the motor (2), the motor (2) protrudes from the hub (15) with its longitudinal end (23) which is supported and laterally surrounded by a crown (12) of the frame (13) and the crown (12) has an annular end strip (21) facing the hub (15) and laterally surrounding an annular end strip (22) of the hub (15) which faces the crown (12).

13 Claims, 4 Drawing Sheets

AXIAL FAN

This is a National Phase Application filed under 35 U.S.C. 371 as a national stage of PCT/IB2007/001781, with the filing date of Jun. 28, 2007, an application claiming the benefit under 35 USC 119(e) of Italian Patent Application BO2006A000652, filed Sep. 21, 2006, the entire content of which is hereby incorporated by reference in its entirety.

TECHNICAL FIELD

This invention relates to an axial fan.

The fan according to this invention may advantageously be used in a system for cooling the engine of a motorcycle to which the following description refers, without in any way limiting the scope of the invention.

BACKGROUND ART

Generally speaking, an engine cooling system comprises a radiator, which is part of a cooling circuit designed to dissipate into the environment the heat which a liquid circulating inside it carries away from the engine, and an axial fan, which generates a forced air flow through the radiator to promote the latter's dissipation of the heat.

The fan is usually driven by an electric motor, and comprises an impeller that is rotationally driven by the shaft of the electric motor. A thermostat which detects the temperature of the liquid in the cooling circuit controls activation of the electric motor, which keeps running until the temperature of the cooling liquid detected returns below a predetermined limit value.

The impeller comprises a plurality of blades, each with its base secured to a hub which is coaxially fixed to the shaft of the electric motor.

The blades extend radially from the hub which normally has a cylindrical cup shape, so that it at least partly encloses and protects the electric motor.

Axial fans of the type described above have several disadvantages, in particular if used with the cooling circuit of a motorcycle and, especially an off-road motorcycle.

In the most common working conditions for motorcycles it is quite easy for water, sand and soil to build up in the gap between the electric motor and the impeller hub, creating a sludge that may cause problems with fan operation.

DISCLOSURE OF THE INVENTION

One aim of the invention is to provide an improved axial fan which is reliable even when operating in particularly difficult environmental conditions.

Another aim of the invention is to provide an improved axial fan which is simple and economical to produce.

Yet another aim of the invention is to provide an improved axial fan which can be assembled by existing production lines without modifying them.

DESCRIPTION OF THE DRAWINGS

This invention accordingly provides am axial fan comprising the characteristics described in one or more of the appended claims. The invention will now be described with reference to the accompanying drawings which illustrate a preferred embodiment of it and in which:

DESCRIPTION OF THE PREFERRED EMBODIMENTS OF THE INVENTION

Figure 1:
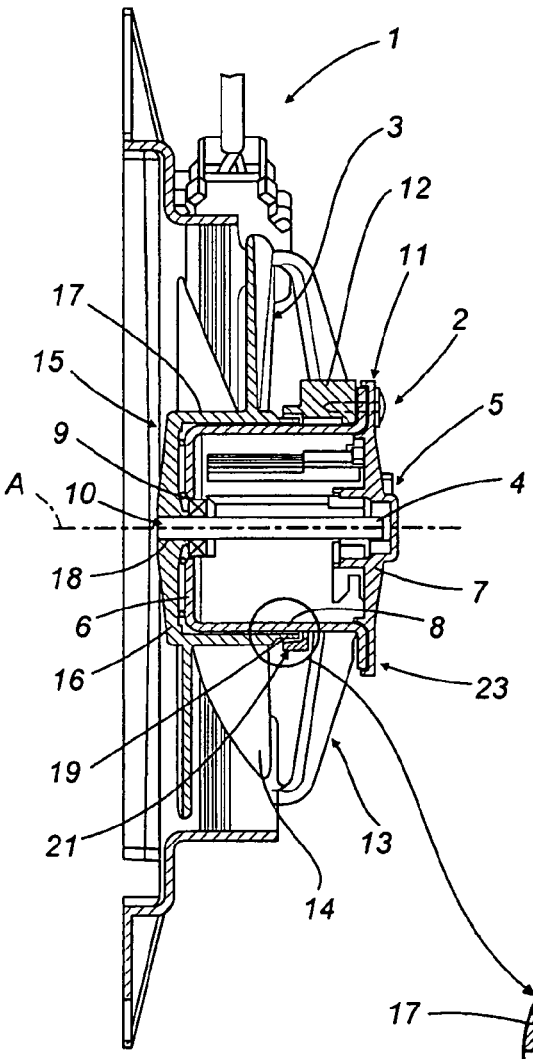
FIG. 1 is a cross section of an axial fan made according to the invention.
Figure 2:
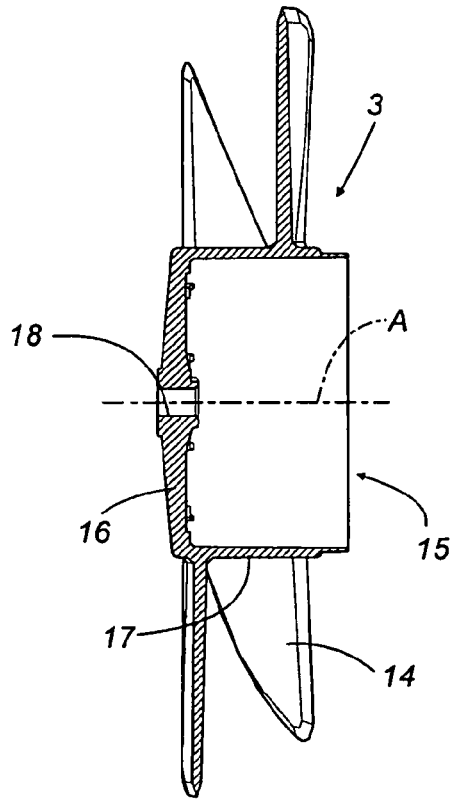
FIG. 2 is a cross section of the impeller of the fan of FIG. 1.

With reference to FIG. 1, the numeral 1 denotes an axial fan which can be used to particular advantage with a cooling circuit (not illustrated) of an engine of a motorcycle (also not illustrated).

The fan 1 comprises an electric motor 2 and an impeller 3, rotationally driven about its central axis A by the shaft 4 of the electric motor 2.

The electric motor 2 comprises a substantially cylindrical protective outer casing 5 with a first end wall 6, a second end wall 7, positioned opposite each other, and an annular side wall 8 extending between the two end walls 6 and 7.

The end wall 6 has a central hole 9 through which one end 10 of the shaft 4 protrudes, while the end wall 7 is defined by a lid from whose periphery there extend three protrusions 11 spaced at angular intervals of 120° about the axis A.

Figure 4:
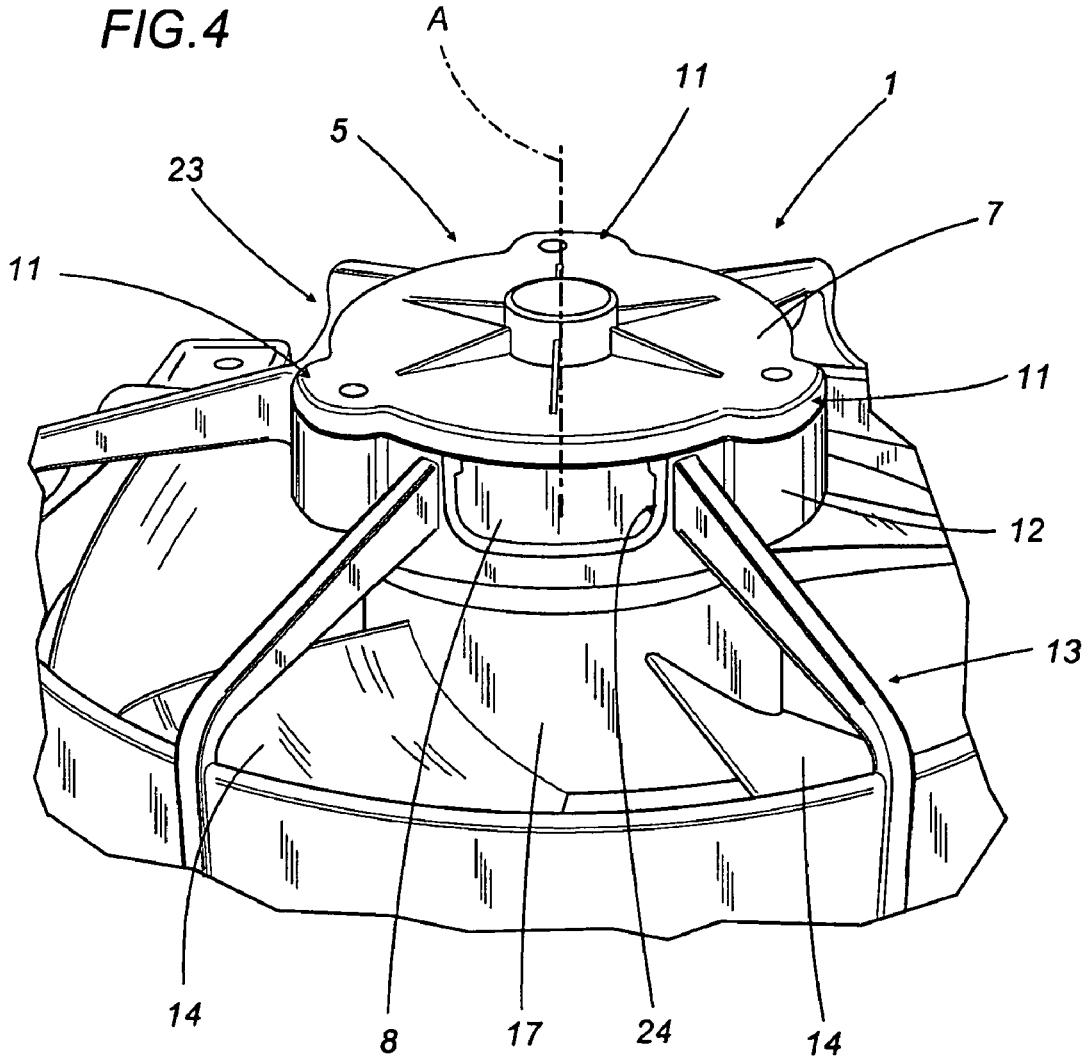
FIG. 4 is a partial perspective view of the fan of FIG. 1.

As shown in more detail in FIG. 4, the protrusions 11 are fixed to a crown 12 that laterally surrounds and supports the electric motor 2 at a longitudinal end 23 opposite the impeller 3. In particular, the crown 12 peripherally surrounds the side wall 8 of the casing 5 and forms part of a cage-like frame 13 by which the entire fan 1 is fixed to the place where it is to operate.

To improve cooling of the electric motor 2, the crown 12 has three openings 24 located at angular intervals of 120° from each other about the axis A. Each opening 24 is angularly positioned between two protrusions 11.

The impeller 3 is housed in the frame 13 and comprises a plurality of blades 14, each of which, starting from its root, extends radially from a hollow central hub 15 fixed coaxially to the above mentioned end 10 of the shaft 4.

The hub 15 has a cylindrical cup shape such that it at least partly encloses and protects the casing 5 of the electric motor 2. More specifically, the electric motor 2 protrudes from the hub 15 with its longitudinal end 23.

The hub 15 is defined by an end wall 16 and an annular side wall 17. The end wall 16 is face to face with the end wall 6 of the casing 5 and has a central through hole 18, aligned with the hole 9 of the casing 5, for fixing the hub 15 to the end 10 of the shaft 4, while the wall 17, like the crown 12, laterally surrounds the side wall 8 of the casing 5.

The crown 12 has an annular end strip 21 facing the hub 15 and laterally surrounding an annular end strip 22 of the wall 17 which faces the crown 12. In particular, the wall 17 of the hub 15 has built on it, on the side opposite the wall 16, a collar 19, which, as illustrated, is preferably thinner than the wall 17 itself and at least partly contained inside an annular groove 20 in the crown 12.

Figure 3:
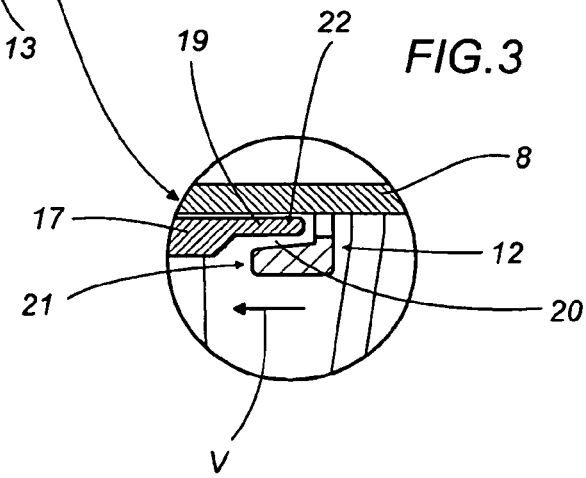
FIG. 3 is an enlarged view of a detail from FIG. 1.

Together with the crown 12, the collar 19 defines a mechanical and aerodynamic barrier that prevents water, sand, soil and dirt in general from finding its way into the gap between the electric motor 2 casing 5 and the hub 15. In practice, the air which the blades 14 attract in the direction V of FIG. 3 flows past the crown 12, which acts as a deflector, and flows along the outside of the hub 15 past the strip 22 of the collar 19.

Figure 5:
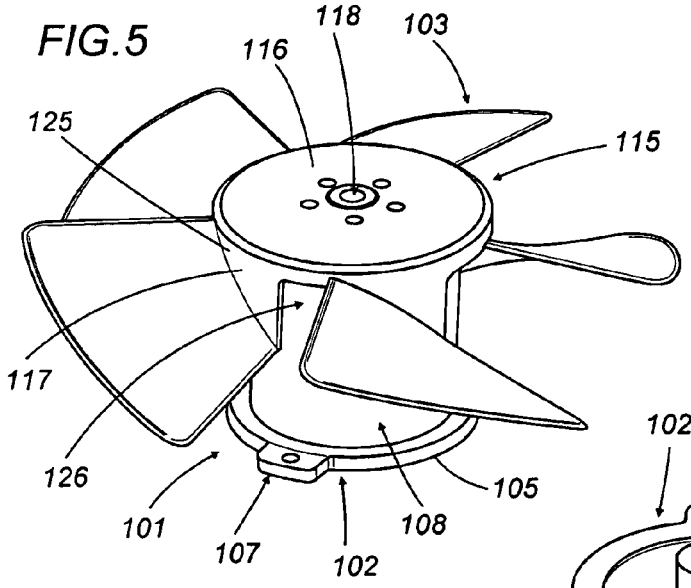
FIG. 5 is a perspective view showing another embodiment of the axial fan according to the invention.
Figure 6:
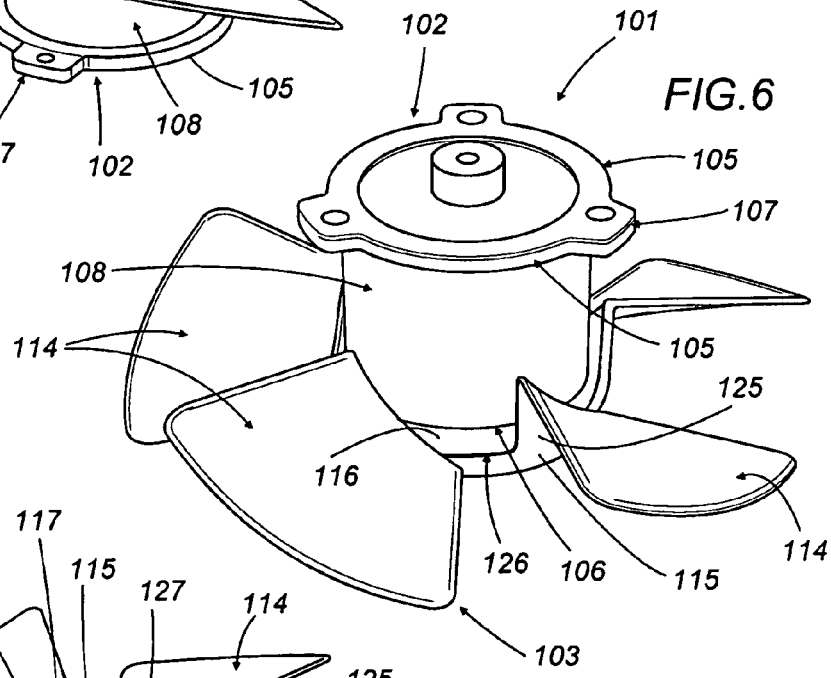
FIG. 6 is a different perspective view of the fan of FIG. 5.
Figure 7:
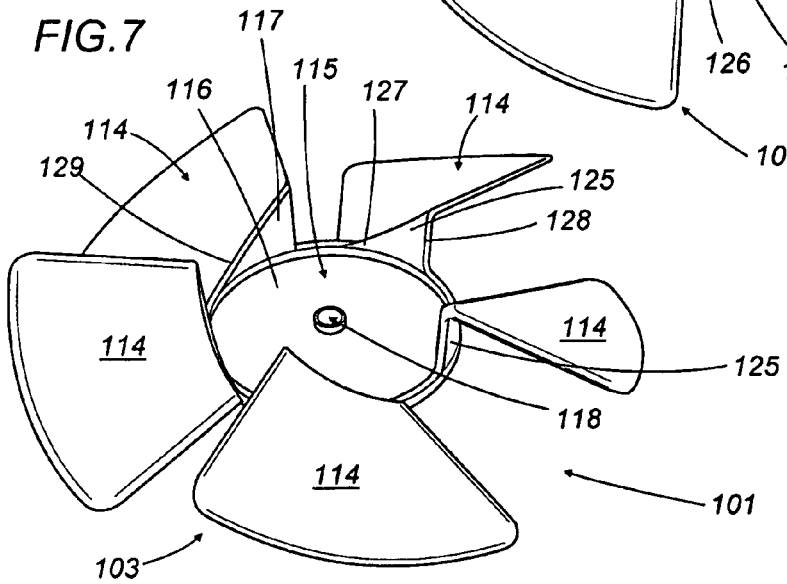
FIG. 7 is a perspective view of a component of the fan of FIG. 5.
Figure 8:
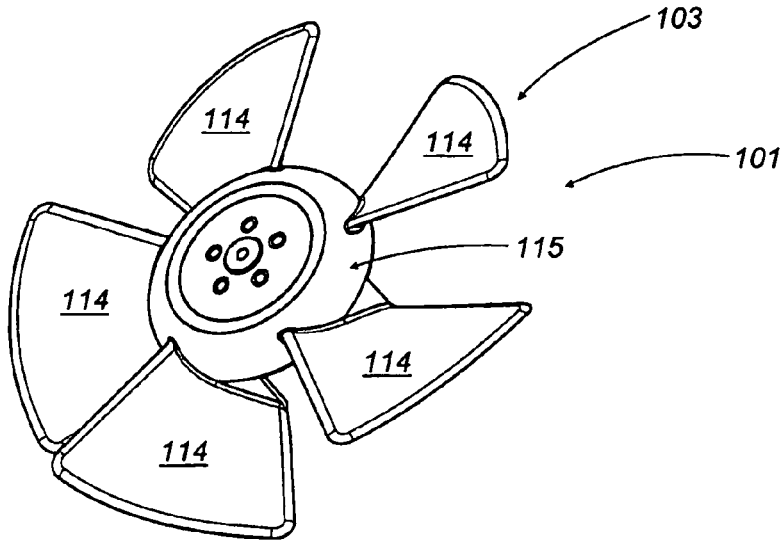
FIG. 8 shows, in another perspective view, the impeller of the fan illustrated in FIGS. 5 and 6.
Figure 9:
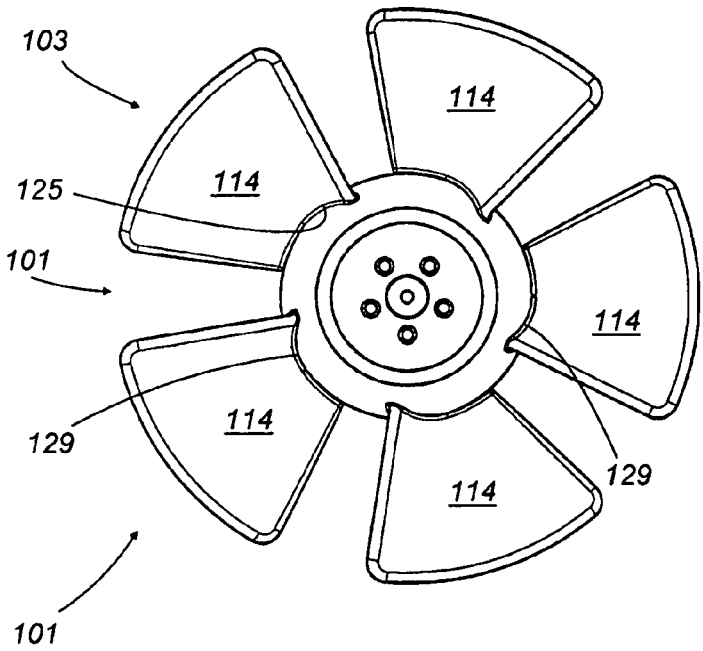
FIGS. 9 and 10 illustrate the impeller of FIG. 8 in a front view and a side view, respectively.

FIGS. 5, 6 and 7 show a different embodiment of the axial fan according to the invention.

The fan illustrated in FIGS. 5, 6 and 7 is denoted by the reference numeral 101 and, like the embodiment described above, can also be used to particular advantage with a cooling circuit (not illustrated) of an engine of a motorcycle (also not illustrated).

For convenience, all the parts of the fan 101 that correspond to those of the fan 1 described above are denoted by the same reference numerals as the latter plus 100.

The fan 101 comprises an electric motor 102 and an impeller 103, rotationally driven about its central axis by the shaft of the electric motor 102.

The electric motor 102 is identical to the electric motor 2 described above and, in particular, comprises a substantially cylindrical protective outer casing 105 with a first end wall 106, a second end wall 107, positioned opposite each other, and an annular side wall 108 extending between the two end walls 106 and 107.

The impeller 103, illustrated separately in FIGS. 7, 8, 9 and 10, comprises a plurality of blades 114, each of which, starting from its root, extends radially from a central hub 115.

The hub 115 has a circular end wall 116 that is integral and coaxial with the shaft of the motor 102. In particular, the end wall 116 is face to face with the end wall 106 of the casing 105 and has a central through hole 118 for fixing the hub 115 to the shaft of the motor 102.

Along the circular periphery of its end wall 116, the hub 115 has an open annular side wall 117 which laterally surrounds the side wall 108 of the casing 105.

The wall 117 is composed of a plurality of sectors 125, alternated in battlement-like fashion with open areas 126 and each supporting a respective blade 114 of the impeller 103. In particular, each blade 114 extends radially from a respective sector 125.

As illustrated in more detail in FIG. 7, each sector 125 has a first, curved perimetric edge 127 positioned around the circular periphery of the end wall 116, a second, straight perimetric edge 128 positioned at right angles to the end wall 116, and a third, curved perimetric edge 129 positioned along the root of the respective blade 114.

Figure 10:
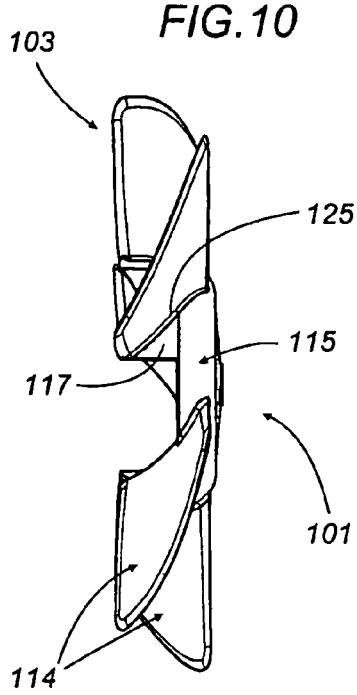

As illustrated in particular in FIGS. 5, 7 and 10, in a planar development, each sector 125 is substantially in the shape of a triangle, and, more specifically, substantially in the shape of a right-angled triangle, with one leg at right angles to the end wall 116 and the hypotenuse positioned along the root of the respective blade 114.

In use, the special open structure of the hub 115, where the wall 117 is formed only by the blade 114 mounting sectors 125, prevents water, sand, soil and dirt in general from accumulating in the space between the electric motor 102 and the hub 115 itself. At the same time, the sectors 125 ensure that the hub 115 is rigid enough to support the blades 114.

The invention claimed is:

1. An axial fan comprising;

a motor having an axially extending side wall; and an impeller having:

a hub that is rotationally driven by the motor; and a plurality of blades extending from the hub;

the hub having;

a circular end wall that is coaxial with a shaft of the motor; and an annular side wall extending axially from a periphery of the circular end wall such that the hub is open in a direction away from the end wall, the hub side wall having a plurality of sectors, each sector supporting one of the plurality of blades of the impeller and covering a portion of the side wall of the motor, the hub side wall further having a plurality of open areas alternating with the plurality of sectors, each open area exposing a portion of the side wall of the motor.

2. The fan according to claim 1, wherein each sector has a first, curved perimetric edge positioned around the circular periphery of the end wall, a second, straight perimetric edge positioned at a right angle to the end wall, and a third, curved perimetric edge positioned along the root of the respective blade.

3. The fan according to claim 1, wherein, in a planar development, each sector has a substantially triangular shape.

4. The fan according to claim 3, wherein, in a planar development, each sector has a substantially right triangular shape, with one leg at a right angle to the end wall and a hypotenuse positioned along a root of the blade.

5. The fan according to claim 4, wherein each open area is axially open in a direction away from the hub end wall.

6. The fan according to claim 5, wherein each open area extends circumferentially around the hub side wall from one of a leading edge or a trailing edge of one of the blades to a root of an adjacent one of the blades, the root being attached to one of the sectors.

7. The fan according to claim 1, wherein each open area is axially open in a direction away from the hub end wall.

8. The fan according to claim 7, wherein each open area extends circumferentially around the hub side wall from one of a leading edge or a trailing edge of one of the blades to a root of an adjacent one of the blades, the root being attached to one of the sectors.

9. The fan according to claim 2, wherein each open area is axially open in a direction away from the hub end wall.

10. The fan according to claim 9, wherein each open area extends circumferentially around the hub side wall from one of a leading edge or a trailing edge of one of the blades to a root of an adjacent one of the blades, the root being attached to one of the sectors.

11. The fan according to claim 1, wherein each open area extends circumferentially around the hub side wall from one of a leading edge or a trailing edge of one of the blades to a root of an adjacent one of the blades, the root being attached to one of the sectors.

12. The fan according to claim 2, wherein each open area extends circumferentially around the hub side wall from one of a leading edge or a trailing edge of one of the blades to a root of an adjacent one of the blades, the root being attached to one of the sectors.

13. The fan according to claim 4, wherein each open area extends circumferentially around the hub side wall from one of a leading edge or a trailing edge of one of the blades to a root of an adjacent one of the blades, the root being attached to one of the sectors.

* * * * *